United States Patent [19]

Nilsson

[11] Patent Number: 4,781,107

[45] Date of Patent: Nov. 1, 1988

[54] METHOD AND APPARATUS FOR MAINTAINING A ZERO-PRESSURE TYPE PLANT

[76] Inventor: Nils-Johan Nilsson, Parkgatan 10, S-832 00 Frösön, Sweden

[21] Appl. No.: 940,155

[22] Filed: Dec. 9, 1986

[51] Int. Cl.[4] ..... F24F 11/00

[52] U.S. Cl. ..... 98/33.1; 98/1.5; 165/16

[58] Field of Search ..... 98/1.5, 33.1, 115.3; 165/16, 31

[56] References Cited

U.S. PATENT DOCUMENTS

| | | | |
|---|---|---|---|
| 2,610,565 | 9/1952 | Stuart . | |
| 3,611,906 | 10/1971 | Lorenz | 98/33.1 |
| 3,646,874 | 3/1972 | Hamerski | 98/1.5 |
| 3,951,336 | 4/1976 | Miller et al. | 98/1.5 |
| 4,428,529 | 1/1984 | Bentsen | 236/49 |
| 4,485,729 | 12/1984 | Crittenden et al. | 98/1.5 |
| 4,667,580 | 5/1987 | Wetzel | 165/16 X |

FOREIGN PATENT DOCUMENTS

| | | | |
|---|---|---|---|
| 2222049 | 11/1973 | Fed. Rep. of Germany . | |
| 2481423 | 10/1981 | France . | |
| 58-104443 | 6/1983 | Japan . | |
| 145113 | 10/1981 | Norway . | |
| 589592 | 1/1978 | U.S.S.R. | 98/1.5 |

*Primary Examiner*—Harold Joyce
*Attorney, Agent, or Firm*—Young & Thompson

[57] ABSTRACT

A method of continuously regulating the operation of a ventilation plant of the zero-pressure type, which is preferably of heat recovery type. This is done by continuously regulating the rotational speed of the exhaust fan. The invention also relates to a ventilation plant for carrying out the method.

6 Claims, 2 Drawing Sheets

METHOD AND APPARATUS FOR MAINTAINING A ZERO-PRESSURE TYPE PLANT

The present invention relates to a method of continuously regulating the operation of a ventilation plant, comprising an air supply blower and an air exhauster, and a ventilation plant for carrying out said method.

In known ventilation plants of the above-mentioned type, the air flow through the fans is often only adjusted once, and it is then assumed that the ventilation plant will continue to function satisfactorily even under other conditions than those prevailing when the adjustment was made. Known ventilation plants have, however, proved to be sensitive to changes in such factors as atmospheric pressure and outside temperature and the associated changes in air density and volume, which can negatively affect the flow through the system. This is especially true for the presently more and more common type of ventilation plant which passes the exhaust air through a heat exchanger for heat recovery before being exhausted into the atmosphere.

In order to avoid the risk of decreased performance, the invention relates to a method which continuously regulates a ventilation plant.

The invention also relates to a ventilation plant for carrying out the method.

Figure 1:
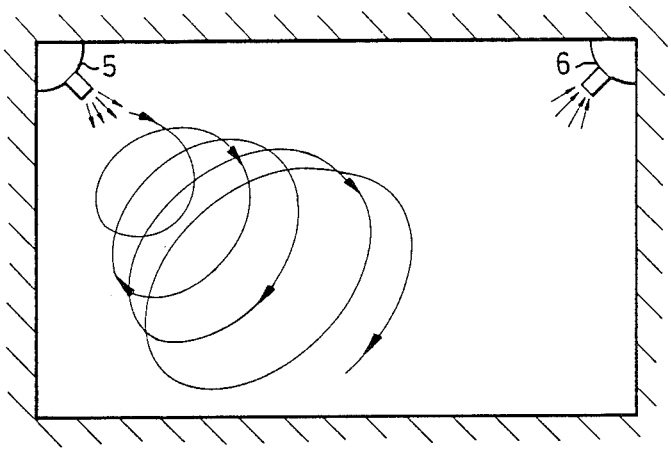
Figure 2:
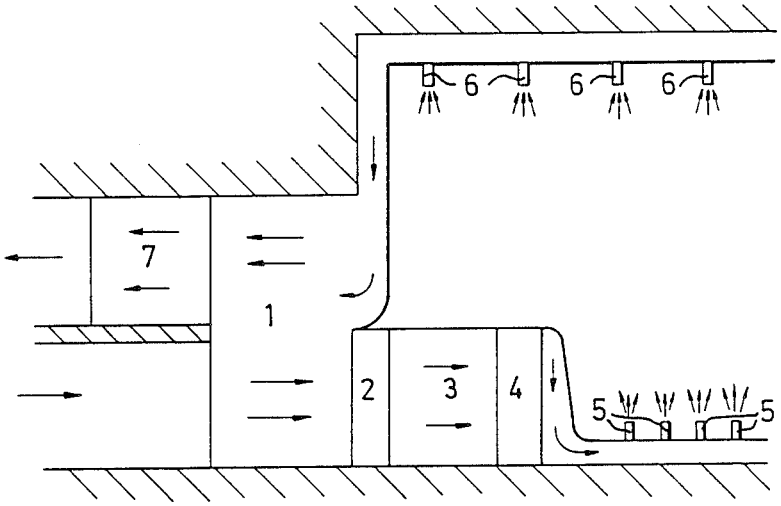
Figure 3:
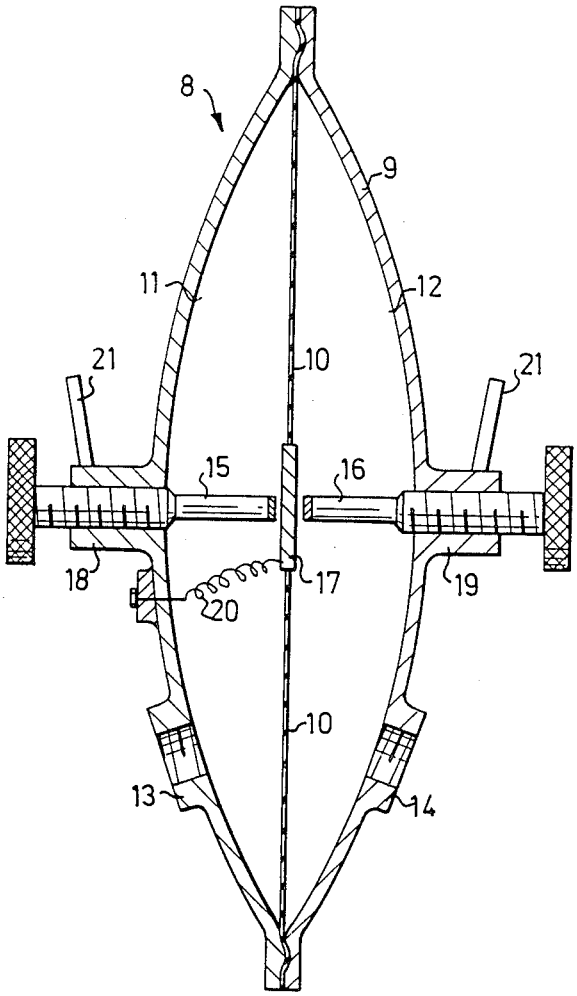

In order to facilitate a better understanding of the invention, an embodiment thereof will be described below with reference to the accompanying drawings, of which:

FIG. 1 is a section through a ventilated room showing the principles for the ventilation thereof, FIG. 2 shows schematically a ventilation plant, which can be regulated with advantage by means of the method according to the invention, and FIG. 3 shows a cross-section through a regulator means according to the invention.

In a ventilation plant of the type shown in FIG. 1, air is blown in from an obliquely downwardly directed air supply opening 5 and is exhausted through an exhaust opening 6. With suitable flow rates through these openings, the intended effect can be achieved, namely that a circulating diffusing flow will be created in the air in the enclosure to be ventilated, as is indicated schematically in FIG. 1. This type of flow provides a mixing of the air in the room and assures that the incoming air flow will be thoroughly mixed with the air present in the room. This desired type of flow has, however, proved to be quite unstable and therefore difficult to maintain continuously during the operation of the ventilation plant.

It is not uncommon in known ventilation plants that under certain operating conditions this circulating diffusing flow is not produced. Rather, the air blown in proceeds more or less directly to the exhaust opening. This means that a portion of the air in the room, lying under an imaginary line between the lower edges of the openings 5,6 will not be changed, and this constitutes a serious disadvantage if the air supply is also intended to heat the room. The thermostat in the room, which controls the temperature of the air blown in, is usually located below said imaginary line and will, under these conditions, indicate that the temperature in the room is too low, and this will result in the exhausted air being heated more and more to no use. Such a situation can thus have disastrous consequences for the energy economy of the plant. If the room is used for work producing environmentally dangerous gases, this lack of air mixing can mean that these gases will be concentrated more and more in the lower portion of the room and thus constitute an unacceptable danger to those present in the room.

The invention is based on the suprising insight that if the static pressures of the outside air and the air in the room are equal, the above-mentioned disruptions of the circulation flow will not occur. By providing the ventilation plant with control equipment which keeps these static pressures equal, the plant can thus be continually regulated during its operation. In order to provide this continuous regulation, the room or building is provided with a regulator means 8, which sends an output signal when the static pressure in the room differs from the static pressure of the outside air. This will be described in more detail below. This output signal then regulates the flow through one of the fans, preferably the exhaust fan.

FIG. 2 shows schematicaly a ventilation plant of heat recovery type, which can be controlled with advantage by the method of the invention. The ventilation plant comprises an air supply fan 3, which blows preheated air through an afterheater battery 4, where the air is heated further, and then through suitable ducts and openings 5 into the room or rooms to be ventilated. Upstream of the air supply fan is a burner 2 and a heat exchanger 1 disposed for preheating the air drawn in from the outside. By means of an exhaust fan 7 air is drawn from the room or rooms through suitable openings 6 and ducts. Upstream of the exhaust fan is a heat exchanger 1 for recovery of the heat content of the exhaust air. Preferably, this consists of a rotary heat exchanger 1 which is partially placed in the inlet to the air supply fan 3 and there functions as a preheater.

Such a plant functions in the following manner. The intake outside air passes, before passing through the air supply fan 3, first past a portion of the rotating heat exchanger 1. There the outside air is preheated, depending on the outside temperature, the inside temperature, the efficiency of the heat exchanger etc. and then passes through the burner disposed upstream from the air supply fan. The burner is preferably thermostat controlled, so that the air reaches the air supply fan 3 at essentially the temperature which is to be maintained in the ventilated room. Before the intake air is delivered to this room, it is additionally heated a few degrees in the afterheating battery 4 disposed downstream of the air supply fan. This air is then blown through suitable openings or nozzles 5 into the room or rooms to be ventilated and heated. The air drawn from said room or rooms through suitable openings 6 is collected in a collection duct or the like and flows through the portion of the rotary heat exchanger located upstream of the exhaust fan 7. In the heat exchanger it gives off a significant portion of its heat before passing through the exhaust fan 7 to the atmosphere.

In plants of this type, the amount of air blown in by the supply fan 3 should be equal to the amount drawn out by the exhaust fan 7. This means in turn that the amount of air delivered to the atmosphere by the exhaust fan should be equal to the amount of air supplied to the room by the air supply fan. At constant pressure the volume which the same amount of air takes up at different temperatures is directly proportional to these temperatures. This means that air expelled into the atmosphere by the exhaust fan which has been cooled by the heat exchanger from +20° C. to −10° C. will have a volume corresponding to 90% of the volume which the same air took up in the room if the pressure in the room is equal to the pressure of the outside air. If the heat exchanger instead cools the air from +20° C. to 0° C., the air expelled into the atmosphere will have a volume corresponding to 93% of the volume which the same air took up in the room. If the ventilation plant is set when the outside temperature is such that the heat exchanger cools the exhaust air from +20° C. to 0° C., and the outside temperature then drops so far that the air is instead cooled to −10° C., if other conditions remain unchanged, the exhaust fan, the volume flow rate of which is constant at constant rpm, will exhaust too great a volume of air. Quantitative calculations of the effect that this will have on the system are very difficult since many factors affect the result, such as changes in the total, static or dynamic pressure, changes in pressure gradients in ventilation systems, etc. Qualitatively, however, it will be understood that a low pressure can arise in the room and experience has proven that this can disrupt the proper no-draft ventilation flow, i.e. the circulating diffusing flows disappear and the incoming air flows directly to the exhaust opening. If the outside temperature rises, a high pressure can of course arise instead.

In order to prevent subatmospheric or overpressures from arising in the room and thus preventing proper mixing of the air, the rotational speed of the exhaust fan is controlled by means of a regulator, which preferably consists of a reversible electric motor, the output shaft of which moves the pulley of a variable speed belt transmission via a lever mechanism or the like. The control signal to the reversible electric motor is sent by a regulator means 8, which when there is subatmospheric pressure sends an output signal which makes the motor rotate in a direction which reduces the rotational speed of the exhaust fan and which when there is overpressure sends an output signal which makes the motor rotate in the other direction.

The regulator means consists of a hollow body 9 of a material which is rigid at the prevailing pressures, for example of hard plastic. The hollow interior of the body is divided by a flexible membrane 10 into two chambers 11,12. One 12 of the chambers communicates with the outside air via a duct to sense its static pressure. The open end of the duct leading to the outside air should suitably be placed so as to be protected from wind. This duct is suitably connected to chamber 12 by means of a conventional hose coupling, which fits in a coupling flange 14 on the body 9, said flange surrounding an opening in the body to one chamber 12. The other side of the body 9 has a corresponding opening and connecting flange 13 whereby the other chamber 11 communicates with the inside air in the room. It should be noted that the open end of the connecting duct for the inside air should be placed so that the local over or underpressures arising due to the dynamic pressure at the supply or exhaust openings 5,6 do not affect the regulator means.

The membrane 10 is provided at its central portion with a contact plate 17 of a suitable electrically conducting material, which is connected via a wire 20 to a terminal block on the body. Directly adjacent the contact plate 17 on both sides of the membrane are contact means 15, 16 which extend from both sides of the body. The contact means can be made of electrically conducting copper or of electrically insulating elements which have electrically conducting contact plates at their ends, connected to the terminal block wires, suitably running through the contact means. The distance between the membrane contact plate 17 and the respective contact means 15,16 when the membrane is in its rest position, i.e. when the pressures in the chambers 11, 12 are equal, can be set by virtue of the fact that the contact means are axially displaceable in the body 9. They can for example be screwed into threaded sleeves 18,19 in the body, as is indicated in FIG. 3. The selected position is fixed by means of lock nuts 21. If so desired, a scale can be arranged on the contact means, providing the set spacing corresponding to the over or underpressure at which the respective electrical circuit is closed. In the example shown, the membrane contact plate 17 is connected via the terminal block to a voltage source and the wires from the contact means 15,16 are connected via the same block to a relay (not shown) which controls the rotational direction of the output shaft of the reversible electric motor depending on which of the circuits is energized. Other arrangements of the electrical control circuits are, however, possible and the above design is therefore only given as a non-limiting example.

The method according to the invention thus provides continuous regulation of a ventilation plant, which balances the inflow and outflow of air so that the static pressure in the room or rooms to be ventilated is kept equal to the static pressure of the outside air. Even if the process is primarily intended for ventilation plants with heat recovery, the method can of course also be used on other types of ventilation plants, which for one reason or another require continuous regulation.

A number of modifications are conceivable within the scope of the invention. For example, the air supply fan can be regulated instead of the exhaust fan, but since ventilation norms require a certain rate of air change it is preferable to balance the air flows by means of the exhaust fan as described above. Furthermore, the amount of exhausted air can be regulated by a combination of fan and damper regulation. Such combined regulation is particularly suitable when a number of separate rooms are to be ventilated. In this case the output signal from the regulator means in the largest room or the room most sensitive to change is allowed to control the exhaust fan, while the control means in the other rooms control dampers or the like at the exhaust openings in these rooms. It should be noted here that the heat regulator means in the other rooms need not be connected to the outside air. Rather the "outside air collecting chamber" can be directly or indirectly connected to the air in the largest room.

Finally, by virtue of the fact that the contact means in the regulator means are adjustable, it is possible to obtain the desired control accuracy and even obtain a minimal non-disruptive overpressure to completely eliminate the risk of temperature drop in the room.

I claim:

1. A method for preventing disturbances of the ventilation air flow in a ventilation plant of the zero-pressure type comprising an air supply blower and an air exhauster of the fan type, wherein the static pressure in the room to be ventilated by the plant is compared with the static pressure of the open air, the difference between said static pressures is used as a regulating variable for controlling the flow through one of the air supply blower and air exhauster in such a way that this difference is eliminated, whereby disturbances in the ventilation flow are compensated by the plant.

2. A method according to claim 1, wherein an output signal from a regulator means, which provides an output signal when the static pressure in the room deviates from the static pressure of the outside air, is sent to a regulator, which controls the flow through one of the air exhauster and the air supply blower in response to the output signal.

3. A ventilation plant of the zero-pressure type, comprising an air supply blower and an air exhauster of the fan type, duct means leading from the air supply blower to the room to be ventilated, duct means leading from the room to be ventilated to the air exhauster, and openings which blow air into and draw air out of said room, a regulator means which provides an output signal when the static pressure in said room deviates from the static pressure of the outside air, means which relays the output signal, and a regulator which receives the output signal and in response thereto increases and decreases the air flow through one of the air exhauster and the air supply blower to compensate disturbances in the ventilation flow.

4. A ventilation plant of the zero-pressure type, comprising (a) an air supply blower and an air exhauster of the fan type;

(b) first duct means leading from the air supply blower to the room to be ventilated;

(c) second duct means leading from the room to be ventilated to the air exhauster;

(d) a plurality of openings communicating with said first and second duct means which blow air into and draw air out of said room, respectively;

(e) regulator means, including (1) a symmetrical hollow body including a flexible membrane dividing the interior of the body into two chambers, said membrane including a central contact plate formed of electrically conducting material;

(2) first and second air intake openings communicating with said body chambers, respectively;

(3) contact means arranged on either side of said membrane and disposed to cooperate with said contact plate;

(4) two electrical circuits each including said contact plate and one of said contact means, each of said circuits being closed when the membrane and contact plate are displaced from a rest position; and (5) third duct means connecting said first and second air intake openings with the outside air and with the air in the room, respectively, said regulator circuits producing an output signal in response to displacement of said membrane when the static pressure in said room deviates from the static pressure of the outside air;

(f) means for relaying said output signal; and (g) a regulator connected with said relay means for receiving the output signal and in response thereto increasing and decreasing the air flow through one of the air exhauster and the air supply blower to compensate disturbances in the ventilator flow.

5. A plant according to claim 4, wherein the distances from the contact means to the rest position of the contact plate are adjustable.

6. A plant according to claim 4, wherein the regulator means regulates the rotational speed of the exhaust fan.

* * * * *